US005624494A

United States Patent [19]

Schmolke et al.

[11] Patent Number: 5,624,494

[45] Date of Patent: Apr. 29, 1997

[54] PARAFFIN COATING DEVICE FOR TEXTILE MACHINES

[75] Inventors: Werner Schmolke; Romeo Pohn, both of Ingolstadt, Germany

[73] Assignee: Rieter Ingolstadt Spinnereimaschinenbau AG, Ingolstadt, Germany

[21] Appl. No.: 450,206

[22] Filed: May 25, 1995

[30] Foreign Application Priority Data

Sep. 28, 1994 [DE] Germany ..... 44 34 566.6

[51] Int. Cl.[6] ..... D02J 3/18; B65H 71/00; D01H 13/30

[52] U.S. Cl. ..... 118/78; 118/407; 118/420; 118/423; 118/421; 57/296; 57/400; 68/200

[58] Field of Search ..... 118/409, 407, 118/420, 423, 78, 77, 73, 74, DIG. 18, DIG. 19, DIG. 22, 421, 76; 68/200; 57/296, 295, 297, 105, 400

[56] References Cited

U.S. PATENT DOCUMENTS

| | | | |
|---|---|---|---|
| 3,358,641 | 12/1967 | Gfeller | 118/78 |
| 3,890,924 | 6/1975 | Horstmann | 118/78 |
| 4,244,176 | 1/1981 | Shimizu et al. | 57/295 |
| 4,345,542 | 8/1982 | Hauner | 118/78 |
| 4,662,166 | 5/1987 | Oexler et al. | 57/296 |
| 5,181,401 | 1/1993 | Hodan | 68/200 |

FOREIGN PATENT DOCUMENTS

| | | | |
|---|---|---|---|
| 2226311 | 12/1973 | Germany . | |
| 2913792C2 | 10/1979 | Germany . | |
| 3422814A1 | 1/1986 | Germany . | |
| 4338453A1 | 5/1995 | Germany . | |
| 1381440 | 1/1975 | United Kingdom | 118/78 |
| 2060721 | 5/1981 | United Kingdom . | |
| 2127048 | 4/1984 | United Kingdom . | |

OTHER PUBLICATIONS

German Search Report.

*Primary Examiner*—Donald E. Czaja
*Assistant Examiner*—Jose A. Fortuna
*Attorney, Agent, or Firm*—Dority & Manning

[57] ABSTRACT

A paraffin coating device of a textile machine which has a fixed paraffin body to coat a yarn running with paraffin is provided with a compact unit supporting the essential parts of the paraffin treatment apparatus and which can be easily removed from the paraffin treatment apparatus for maintenance purposes in order to facilitate handling and to improve even application of paraffin on the yarn.

10 Claims, 5 Drawing Sheets

PARAFFIN COATING DEVICE FOR TEXTILE MACHINES

The instant invention relates to a paraffin coating device according to the introductory clause of claim 1. A paraffin coating device is known from DE 34 22 814 A1, for example. In the known paraffin coating device a yarn to be provided with a paraffin coating runs over a fixed paraffin body which is rotatably mounted, whereby its rotational axis is perpendicular to the running direction of the yarn. The delivered yarn is guided over the front of the paraffin body so that a thin layer of paraffin is applied to the yarn. In order to ensure even application it is necessary that the paraffin body remain always in the same position relative to the course of the yarn. This also applies when it becomes smaller due to removal of paraffin. In order to ensure this, the paraffin body is mounted on its rotational axis so that it can be displaced in axial direction. A stop is provided in that case against which it is pressed in the direction of the yarn by means of a spring. The contact between the yarn and the paraffin body is on the front of the latter. Due to the fact that it rotates slowly around an axis at a right angle to the direction of yarn movement, the front of the paraffin body is given a cambered surface. As can be seen in DE 34 22 814 A1, paraffin coating devices re also used in bobbin forming machines, directly in the area before the yarn draw-off. In rotor spinning machines for example, where a fiber sliver coming out of a presentation can is twisted into a yarn by a spinning rotor, the paraffin coating device is located between the rotor box in which the yarn is twisted, and the winding unit.

For even application of paraffin on the yarn it is important that the surfaces of the paraffin body over which the yarn passes be always in the same position. Thereby the contact conditions between the yarn and the paraffin body remain constant so that the paraffin abrasion by the yarn is always constant and thereby the paraffin application on the yarn also remains constant. The always constant positioning of the paraffin body relative to the yarn is ensured through the fact that the paraffin body is pressed axially against a stop, i.e. by the contact surface with the yarn. For this purpose the paraffin coating device is provided with an elastic element which ensures that the paraffin body is always pressed against its stop. As another component which is also important for the evenness of the paraffin application on the yarn, the paraffin coating device is provided with a guiding hoop for the yarn. It ensures that the yarn not only bears upon the paraffin body but also on another component, so that only a small portion of the force produced by the yarn at a right angle to its direction of movement is supported by the paraffin body. Otherwise the paraffin application on the yarn would be excessive. The function of the yarn guiding hoop as well as that of the support of the paraffin body can be implemented with one component as in DE 34 22 814, or by means of separate components.

The known embodiments have the disadvantage that during maintenance or replacement of the paraffin coating device, the yarn guiding hoop and the axial support of the paraffin body must be removed in order to provide free access to the paraffin body. This has however as a result that following this operation the support and the yarn guiding hoop must be repositioned again, at least partially. In the German patent application P 43 38 453.6 a paraffin coating device is described which has a covering for the paraffin body to prevent free paraffin particles which may be produced by abrasion for instance, from leaving the area of the paraffin coating device and from causing disturbances in the spinning or winding process. This paraffin coating device has also the disadvantage that for maintenance, in addition to the yarn guiding hoop and the stop for the paraffin body, also its covering must be removed.

It is the object of the instant invention to design a paraffin coating device in such manner that its maintenance can be simplified considerably and can be rendered less time-consuming, whereby in particular no positioning of previously removed components is necessary following maintenance.

This object is attained by the invention through the characteristics of claim 1.

The design of the paraffin coating device according to the invention is such that the geometry of yarn application need no longer be adjusted at each individual winding station, but thanks to the integration of the yarn guiding element and of the axial stop of the paraffin body all the components to be adjusted are adjusted equally at all the paraffin application stations. by contrast with the known paraffin coating devices, where the stop for the paraffin body and the guiding hoop for the yarn must be adjusted individually at every spinning station relative to the support and relative to each other, this is omitted with the instant invention. The positioning of stop and guiding hoop relative to each other which is important for uniform application of paraffin on the yarn at each spinning station is ensured in a simple manner by the invention. The operator need not take any action for this, as the compact unit makes the adjustment automatically. The adjustment always remains constant, even if stop and guiding hoop have been removed from the paraffin coating device in the meantime for maintenance purposes. The adjustment of the compact unit of the paraffin coating device of the textile machine is not entirely as determining a factor for even application of paraffin on the yarn. It is sufficient for this to ensure by means of measures in manufacture that the compact unit can always be attached at the same location of the support. The important adjustment of guiding hoop, stop and thereby also paraffin body in relation to each other remains advantageously unchanged in spite of disassembly of important components of the paraffin coating device. In order to service the paraffin coating device, the compact unit can advantageously be removed by a manipulation, so that the paraffin body is freely accessible and can be controlled or exchanged. Neither the guiding hoop for the yarn nor the stop for the paraffin body need be removed separately for this, but instead the paraffin body is exposed through the disassembly of the compact unit in one action. It is especially advantageous in this case that when the compact unit is re-inserted into the paraffin coating device, all the components are automatically adjusted by the device for the positioning of the compact unit.

It is especially advantageous for the compact unit to comprise also a covering for the paraffin body to retain free paraffin particles. This makes it possible to ensure that no disturbances of the spinning or winding operation are caused by free paraffin particles detached from the yarn or, due to the contact of the paraffin cake against the stop, from the latter. The covering is also removed together with the compact unit from the paraffin coating device without additional special measures being required. By simply removing the covering together with the compact unit it is possible to remove the covering from the textile machine and to clean it not in the immediate proximity of the machine, so that the special advantage is provided that the cleaning process of the compact unit also does not cause any free paraffin particles to get into the spinning or winding process. The guiding hoop can advantageously also be cleaned during the cleaning of the covering, as well as the stop for the paraffin body which can also loosen free paraffin particles due to its sliding against the face of the paraffin body. it is especially advantageous to make the covering tubular in shape so that it surrounds the paraffin body over its entire circumference. The compact unit thus becomes especially space-saving and light in weight. it is especially advantageous for the covering to constitute at the same time the basic body of the compact unit on which the other components, such as axial support and guiding hoop are located. It is also especially advantageous for the device for the positioning and attaching to the support of the textile machine to be combined with the covering. The covering is advantageously provided with an opening for the entry of the yarn,so that it may have unhindered access to the face of the paraffin body in order to be suitably coated with paraffin. An opening which lies in the direction of movement of the yarn before the paraffin body is especially advantageous. Another especially advantageous embodiment of the invention is provided with a yarn inlet opening through which the yarn handled outside the covering can reach the paraffin body the yarn is handled outside the covering for instance when it is pieced after yarn breakage. The yarn must then be brought back behind the covering, and for this the yarn inlet opening is used. Covering on the face of the paraffin body is thereby achieved, while normal handling of the yarn is ensured at the same time. In an especially advantageous embodiment of the invention the stop can be adjusted in axial direction so that the application of paraffin on the yarn can be controlled easily. The stop is advantageously made in two parts, so that better frictional conditions exist between the stop and the face of the paraffin body. The compact unit is especially advantageous if it is made essentially in form of a plastic extruded part. This makes it possible to produce it at low cost and precisely to measure so that the compact unit is interchangeable among any of the different paraffin coating devices. Elements such as the guiding hoop and the stop are here advantageously also always of the same design and need not be adjusted separately. It is especially advantageous if the guide hoop is made of a wear-resistant material and it is placed in the compact unit. This ensures that the paraffin coating device will have a long life and can at the same time be produced easily and at low cost. The detachable attachment of the compact unit on the support of the textile machine is especially advantageous if it is by means of a spring-loaded hooks which hook into corresponding openings in the support. This ensures raid assembly and disassembly of the compact unit, with the hooks constituting at the same time a stop so that the compact unit can be attached to the support in an adjusted manner. In another advantageous embodiment the compact unit is provided with an additional holding device by means of which it can be attached to the textile machine in a disassembled state. This makes it possible for the compact unit to be laid down at a defined location by the operator during maintenance of the paraffin coating device so that he will have both hands free, e.g. to replace the paraffin body. The compact unit is thus protected from damage or dirt which may be produced if the compact unit were to be placed by the operator on an assembly table or otherwise be put out of hand. The additional holding device makes it possible to put down the compact unit directly next to the paraffin coating device on the support so that the operator can begin immediately the maintenance tasks without having to be turned around. The compact unit can remain during the entire time in that state. At the same time it assumes a readiness position from which it can be immediately be attached again on the paraffin coating device.

Other advantageous embodiments of the invention are discussed in the description below. The invention is described below through drawings.

Figure 1:
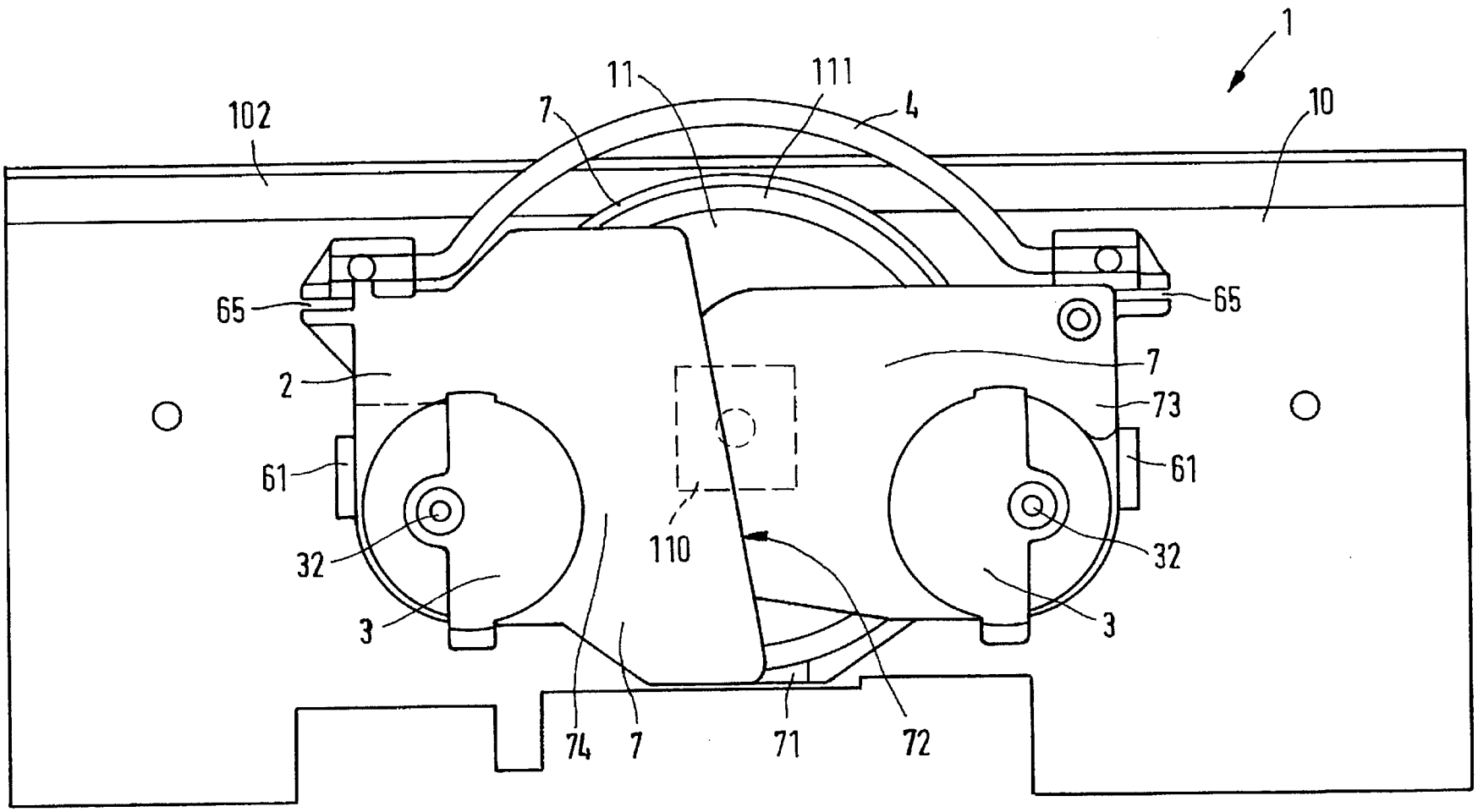
FIG. 1 shows a top view of a paraffin coating device according to the invention.

FIG. 1 shows a top view of a paraffine treatment apparatus 1 according to the invention. The paraffine treatment apparatus 1 has a support 10 which is made in form of a plate and is in turn attached to the textile machine. The compact unit 2 is detachably attached by means of hooks 61 to the support 10. The compact unit 2 is provided with a covering 7, a guiding hoop 4 over it. During the application of paraffin on the yarn the latter glides over the guiding hoop after having left the paraffin body 11. The compact unit 2 is furthermore provided with two stops 3 against which the paraffin body 11 bears. The paraffin body 11 is supported by the square 110 which is shown in FIG. 1 with its otherwise not visible edges. It is subjected to force in a known manner by its seat 111, which is in form of a plate, by means of a spring on its back, so that it is pushed on the square 110 in the direction of the stops 3. The yarn which is not drawn in is conveyed to the paraffin body 11 through opening 71. It leaves the paraffine treatment apparatus 1 above the paraffin body 11 and is at the same time deflected by the guiding hoop 4. In case of yarn breakage, such as may occur in a rotor spinning machine, the yarn is handled, e.g. knotted or pieced outside the paraffin coating device. Following this it must again be applied to the paraffin body. This is possible because the covering 7 is provided with a yarn inlet opening 72. The latter is constituted in that the right side 73 of the forward covering 7 is closer to the paraffin body 11 than the left side 74 of the forward covering 7. In this case the right edge of the left side covering 74 extends at approximately the same slant as that of the yarn at the time of its transfer to the yarn inlet opening 72. The right side 73 and the left side 74 of the covering 7 overlap so that no free paraffin particles can fall out of the covering 7 through the yarn inlet opening.

Figure 2:
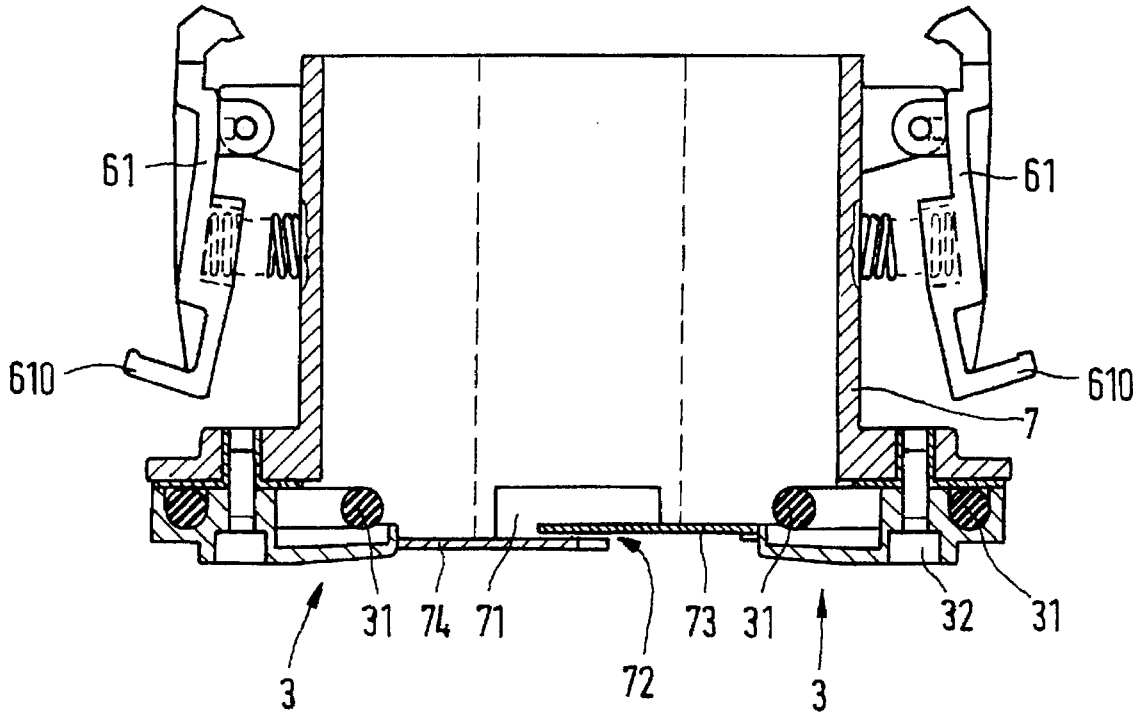
FIG. 2 shows a horizontal section through the compact unit of the paraffin coating device of FIG. 1 at the level of the stops.

FIG. 2 shows the compact unit 2 of FIG. 1 in a section which is approximately at the level of the attachment means 32 of the stops 3 of FIG. 1. The hooks 61 by means of which the compact unit is detachably attached to the support are not shown in a section. The covering 7 surrounds the paraffin body 11 of FIG. 1 around its circumference since it is tubular. At the front the covering, as described earlier in FIG. 1, is realized by the right side 73 and the left side 74 of the covering 7. The opening 71 in the covering 7 through which the yarn reaches the paraffin body can be seen clearly in FIG. 2. FIG. 2 also shows the overlap of the yarn inlet opening ensuring that no free paraffin particles can leave the covering 7 through the yarn inlet opening 72. The stops 3 against which the paraffin body bears at the front are made in form of rubber rings 31. To adjust the stops 3 a prop-up plate can be pushed between the rubber rings 31 and the covering 7 after unscrewing the screw 32 so that the rubber ring 31 is moved further in the direction of the viewer of FIG. 1 with the result that the paraffin body 11 is pushed by its plate-shaped seat 111 correspondingly further in the direction of the viewer. This has the result that the yarn is deflected more by the paraffin body 11 and is thus also coated more heavily with paraffin. The spacer plates an have different thicknesses and are inserted on both sides into the seats 3. The prop-up plates, the adjusting means of the stop formers, can be colored so that they may be recognized by the operator in the normal operating state of the paraffin coating device, so that the setting of the stops can be recognized immediately. The hooks 61 are provided with actuating levers 610 on which the operator pushes so that the hooks open and the compact unit 2 can be detached from the support 10.

Figure 3:
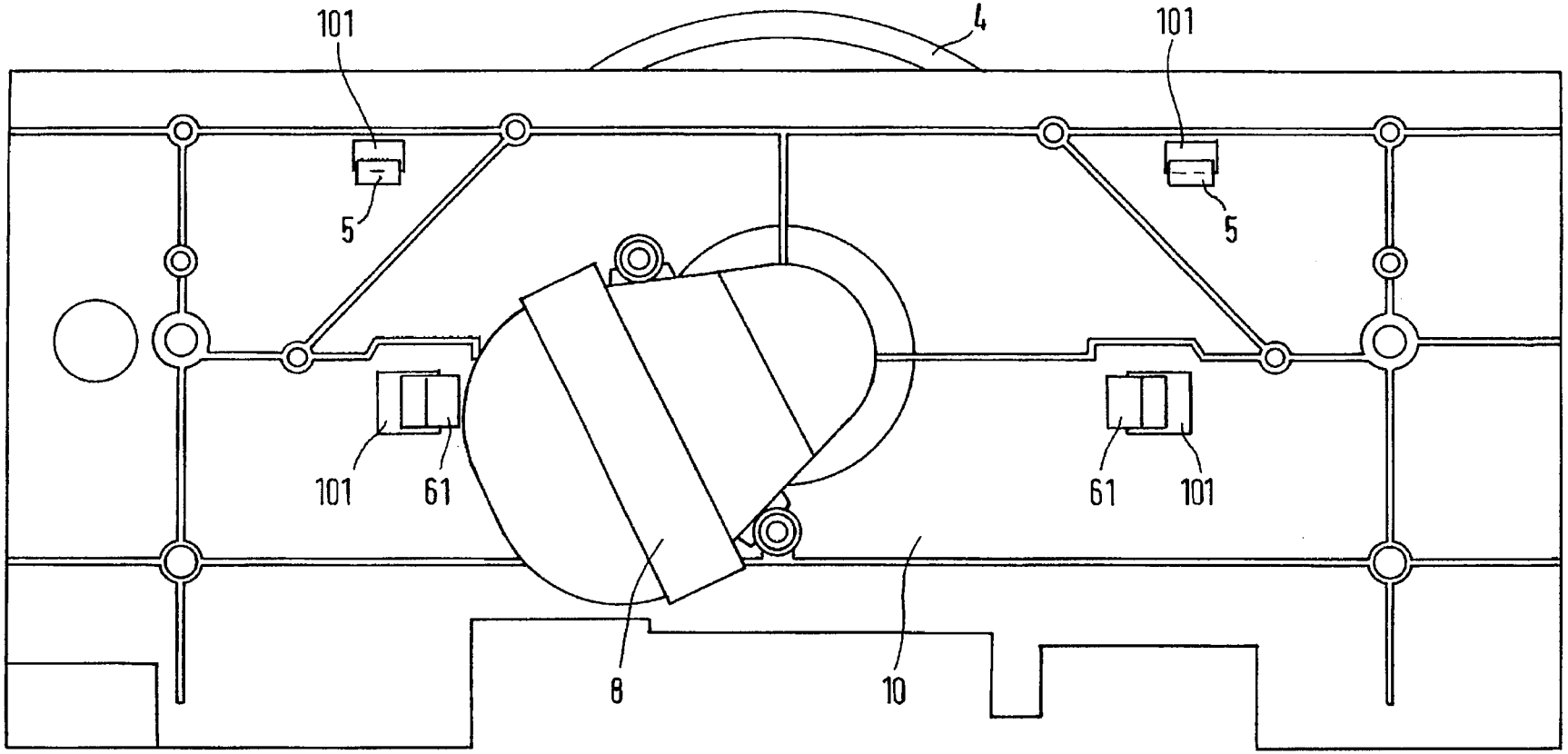
FIG. 3 shows a rear view of FIG. 1.

FIG. 3 shows the back of FIG. 1. The support 10 is has perforations 101 into which the hooks 61 enter in part for the detachable attachment of the compact unit. The devices 5 for the positioning of the compact unit enter the other perforations 101. The devices 5 for the positioning of the compact unit 2 are made in form of hooks which are fixedly attached to the compact unit 2. With these devices 5 for positioning the compact unit is positioned precisely on the support 10 so that it is positioned in relation to the other components of the textile machine. A motor 8 which rotates the paraffin body 11 via the square 110 in a known manner attached on the back of the support 10 (see also FIG. 5). The guiding hoop 4 of the compact unit extends over the upper edge of the support 10.

Figure 4:
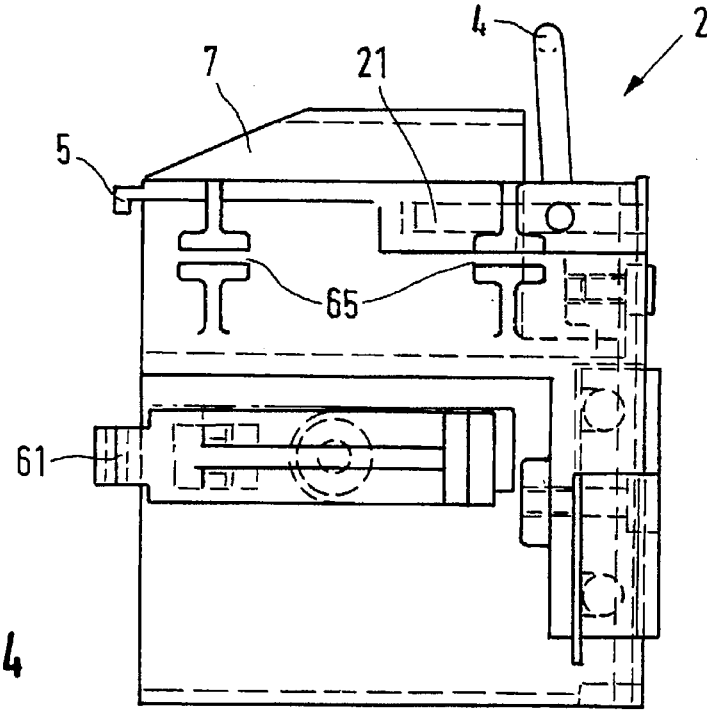
FIG. 4 shows a side view of the compact unit, in a section.

FIG. 4 shows a side view of the compact unit. A device 5 for the positioning of the compact unit is located on the covering 7, on the side towards the support 10. It is made in form of a hook, as already shown in FIG. 3, is snapped into perforations 101 of the support 10. The compact unit 2 is held by means of the hooks 61. FIG. 4 shows how the guiding hoop 4 is inserted into the compact unit 2. The compact unit 2 is provided with openings 21 for that purpose into which the ends of the guiding hoop 4 are inserted. The guiding hoop 4 is made of steel so that it is sufficiently wear-resistant. The compact unit 2 is practically not subjected to any wear with the exception of the covering 73 on the right side. Therefore the right-side covering 73 is advantageously made so as to be wear-proof, i.e. of steel. By means of the additional holding devices 65 which, as can be seen in FIG. 1, are located on either side of the compact unit, the latter can be attached to the textile machine during the time when it is removed from the paraffin coating device for reason of maintenance. It need not necessarily be attached thus on the support 10. In the present embodiment the compact unit 2 can be hooked up on the slanted upper part 102, next to the area where the paraffin coating device is located. The additional holding device 65 has a slit in which the upper part 102 of the support 10 can be clampingly held. This has the advantage that the compact unit need not be held by the operator during maintenance of the paraffin coating device or be laid down far from the machine, but that it can be attached in immediate proximity of the paraffin coating device. Maintenance is thereby rendered especially operator-friendly and quick.

Figure 5:
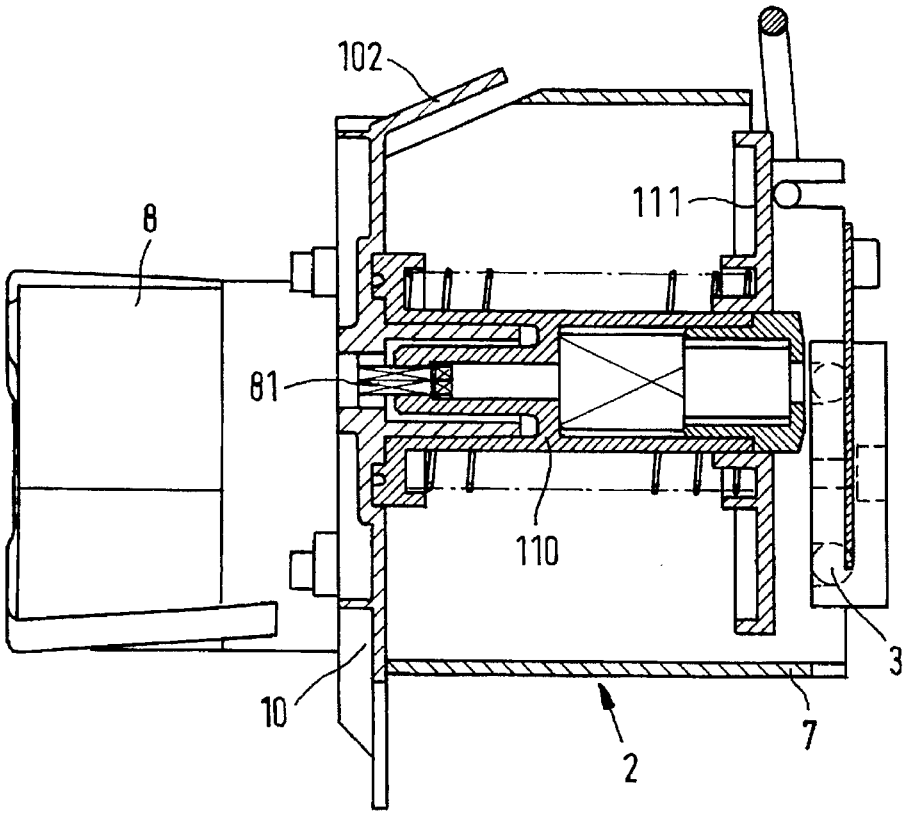
FIG. 5 shows a side view of the paraffin coating device in a section.

FIG. 5 shows a side view of the paraffine treatment apparatus of FIG. 1 in a section. The section is vertical through the center of the paraffin coating device of FIG. 1. The motor 8 is located on the back of the support 10. On the opposite side of the support 10 is the seat 111 of the paraffin body which is not drawn here. The seat 111 slides in axial direction on the square 110. On the latter the paraffin body, which has a corresponding square hole in the center, is installed. The seat 111 is subjected on its side towards the support 10 to the force of an elastic element in order to push the paraffin body against the stops 3. The square 110 is mounted rotatably on the support 10 and is rotated via a drive shaft 81 by the motor 8. The seat 111 as well as the square 110 are enclosed by the compact unit 2 with its covering 7.

Figure 6:
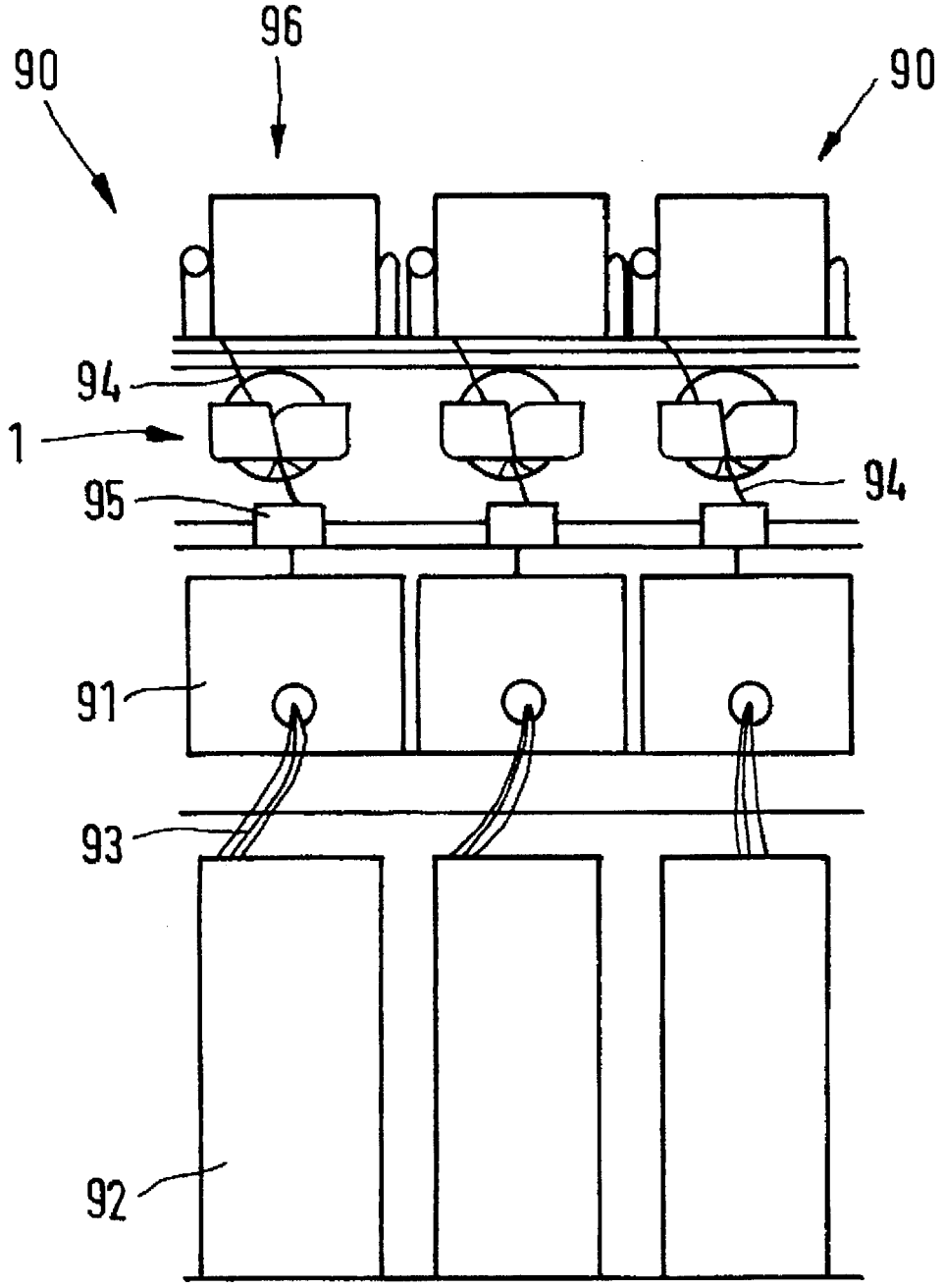
FIG. 6 shows a partial view of a textile machine.

FIG. 6 shows a partial view of a textile machine which is a rotor spinning machine in this case. Three spinning stations are shown as an example, whereas rotor sinning machines may have up to 280 spinning stations which are arranged in two rows. The spinning station of a rotor spinning machine consists of the spinning box 91 to which a fiber sliver 93 is presented from a presenting can 92. The fiber sliver 93 is opened into individual fibers in a known manner and is then twisted in a spinning rotor into a yarn 94. The latter is withdrawn from the spinning box 91 by means of draw-off rollers 95 and is conveyed to a winding unit 96. The paraffine treatment apparatus 1 is located between the pair of draw-off rollers 95 and the winding unit 95. In rotor spinning machines yarn breakage may occur at the different spinning stations 90 which are then repaired by an automatic service unit. In that case the yarn is brought back from the winding unit 96 for example, and is fed back into the spinning box 91. In this process the newly spun yarn is pieced to the end of the fed-back yarn. During this maintenance operation the yarn is handled outside the paraffine treatment apparatus 1. After piecing of a new yarn it is however immediately presented to the paraffin coating device into which it is introduced thought the yarn inlet opening, as described above.

The invention claimed is:

1. A textile machine paraffin coating device, comprising:

a support configured for mounting on a frame of a textile machine, said support further comprising an attachment device for receipt of a paraffin body;

a stop disposed relative said support to contact said paraffin body and define a fixed position for said paraffin body on said support;

a guiding hoop disposed relative said support to guide a yarn over said paraffin body;

a compact unit assembly detachably mounted on said support, said stop and said guiding hoop mounted on said compact unit assembly;

a positioning device configured relative said support and said compact unit assembly to assure a fixed position of said compact unit assembly on said support; and a detaching mechanism configured with said compact unit assembly to releasably attach said compact unit assembly to said support.

2. The paraffin coating device as in claim 1, wherein said compact unit assembly further comprises a covering disposed to surround essentially the circumference of a paraffin body on said attachment device.

3. The paraffin coating device as in claim 2, wherein said covering comprises a tubular form.

4. The paraffin coating device as in claim 2, wherein said covering comprises an opening for access of a yarn to said paraffin body.

5. The paraffin coating device as in claim 4, wherein said covering further comprises a yarn inlet passage whereby yarn handled outside of said covering can be subsequently brought back through said covering into contact with said paraffin body.

6. The paraffin coating device as in claim 1, wherein said stop is adjustable in an axial direction of movement of said paraffin body along said attachment device.

7. The paraffin coating device as in claim 6, wherein said stop is formed in at least two parts.

8. The paraffin coating device as in claim 1, wherein said guiding hoop is made of a wear resistant material and is removably inserted into said compact unit assembly.

9. The paraffin coating device as in claim 1, wherein said detaching mechanism comprises at least one spring loaded hook device said hook device releasably attaching into an engaging slot defined in said support.

10. The paraffin coating device as in claim 1, further comprising a holding device for attaching said compact unit assembly to a temporary location on said textile machine apart from said support.

* * * * *